United States Patent [19]

Marsh

[11] 4,115,115

[45] Sep. 19, 1978

[54] CRYSTALLIZATION OF SELENIUM IN POLYMER MATRICES VIA IN SITU GENERATION OF ORGANIC CRYSTALLINE NUCLEATION SITES

[75] Inventor: Dana G. Marsh, Rochester, N.Y.

[73] Assignee: Xerox Corporation, Stamford, Conn.

[21] Appl. No.: 836,166

[22] Filed: Sep. 23, 1977

[51] Int. Cl.[2] ..... G03G 5/04

[52] U.S. Cl. ..... 96/1.5 R; 96/1 PC; 427/123; 427/383 R

[58] Field of Search ..... 96/1.5, 1 R, 1 PC; 427/123, 383

[56] References Cited

U.S. PATENT DOCUMENTS

| | | | |
|---|---|---|---|
| 3,961,953 | 6/1976 | Millonzi et al. | 96/1.5 R |
| 3,994,791 | 11/1976 | Chu et al. | 96/1.5 R |
| 4,049,449 | 9/1977 | Marsh | 96/1.5 R |
| 4,050,935 | 9/1977 | Limberg et al. | 96/1.5 R |

*Primary Examiner*—John T. Goolkasian
*Attorney, Agent, or Firm*—J. J. Ralabate; A. A. Mahassel; E. O. Palazzo

[57] ABSTRACT

Disclosed is a method of forming a layer of particulate trigonal selenium dispersed in a polymeric matrix. The method involves:

(a) forming a solution containing:
  i. dibenzoyl peroxide,
  ii. an organo selenium compound which interacts with dibenzoyl peroxide to form zero valent selenium, and
  iii. a matrix polymer which is substantially non-reactive with dibenzoyl peroxide and the organo selenium compound,
  in a volatile solvent;

(b) applying the solution to a substrate in the form of a thin film;

(c) allowing the dibenzoyl peroxide and organo selenium compound to react thereby forming amorphous zero valent selenium particles dispersed in the matrix polymer; and (d) heating the matrix polymer/zero valent selenium combination to a temperature and for a time sufficient to convert the amorphous zero valent selenium to its crystalline, trigonal form.

7 Claims, No Drawings

CRYSTALLIZATION OF SELENIUM IN POLYMER MATRICES VIA IN SITU GENERATION OF ORGANIC CRYSTALLINE NUCLEATION SITES

BACKGROUND OF THE INVENTION

This invention relates to the art of electrostatographic copying, an electrostatographic photosensitive device and more particularly to a method of fabricating such a device comprising particulate trigonal selenium in a polymeric matrix.

The art of electrostatographic copying, originally disclosed by C. F. Carlson in U.S. Pat. No. 2,297,691, involves as an initial step, the uniform charging of a plate comprised of a conductive substrate normally bearing on its surface a non-conductive barrier layer which is covered by a layer of photoconductive insulating material. This is followed by exposing the plate to activating radiation in imagewise configuration which results in dissipation of the electrostatic charge in the exposed areas while the non-exposed areas retain the charge in a pattern known as the latent image. The latent image is developed by contacting it with an electroscopic marking material commonly referred to as toner. This material is electrostatically attracted to the latent image which is, by definition, in the configuration of those portions of the photoreceptor which were not exposed to the activating radiation. The toner image may be subsequently transferred to paper and fused to it to form a permanent copy. Following this, the latent image is erased by discharging the plate and excess toner is cleaned from it to prepare the plate for the next cycle. Typically, the photosensitive device is in the form of a cylindrical drum generally referred to as the photoreceptor.

A photoconductive material which has had wide use as a reusable photoconductor in commercial xerography comprises vitreous or amorphous selenium. Vitreous selenium in essence comprises super cooled selenium liquid and may readily be formed by vacuum evaporation by cooling the liquid or vapor so suddenly that crystals of selenium do not have time to form. Although vitreous selenium has had wide acceptance for commercial use in zerography, its spectral response is limited largely to the blue-green portion of the electromagnetic spectrum which is below about 5200 Angstrom units. In addition, the preparation of vitreous selenium by vacuum deposition requires a significant capital expenditure for vacuum coating apparatus and closely controlled process parameters are required in order to obtain a photoconductive layer having the desired electrical characteristics. In general, one requirement of a photoconductor such as vitreous selenium is that its resistivity should drop at least several orders of magnitude in the presence of activating radiation in comparison to its resistivity in the dark. Also, the photoconductive layer should be able to support a significant electrical potential in the absence of radiation.

Selenium also exists in a crystalline form known as trigonal or hexagonal selenium which is well known to the semi-conductor art for use in the manufacture of selenium rectifiers. In the crystalline trigonal form, the structure of the selenium consists of helical chains of selenium atoms which are parallel to each other along the crystalline c-axis. Trigonal selenium is not normally used in xerography as a homogeneous photoconductive layer because of its relatively high electrical conductivity in the dark, although in some instances trigonal selenium can be used in binder structures where trigonal selenium particles are dispersed in a matrix of another material such as an electrically insulating resin, an electrically active organic material, or a photoconductor such as vitreous selenium. U.S. Pat. Nos. 2,739,079 and 3,692,521 both described photosensitive members utilizing small amounts of crystalline, trigonal selenium contained in predominantly vitreous selenium matrices. In addition, copending U.S. patent application Ser. No. 669,915 describes a special form of red-hexagonal selenium suitable for use in binder structures in which finely divided trigonal selenium particles are contained in a resin binder matrix. These types of devices are normally prepared by mixing finely divided trigonal selenium in a solution of the polymer and coating the resulting dispersion onto a substrate. Removal of the solvent provides the finished layer.

It would be desirable, and it is an object of the present invention, to provide a process for the preparation of a layer of particulate trigonal selenium dispersed in a polymeric matrix wherein the selenium is generated in situ.

A further object is to provide a novel method for the preparation of an electrostatographic photoreceptor which comprises a layer of particulate trigonal selenium dispersed in a polymeric matrix.

SUMMARY OF THE INVENTION

The present invention is a method of forming a layer of particulate trigonal selenium dispersed in a polymer matrix which comprises:

(a) forming a solution containing:
  i. dibenzoyl peroxide,
  ii. an organo selenium compound which interacts with dibenzoyl peroxide to form zero valent selenium, and
  iii. a matrix polymer which is substantially non-reactive with dibenzoyl peroxide and the organo selenium compound,
  in a volatile solvent;

(b) applying the solution to a substrate in the form of a thin film;

(c) allowing the dibenzoyl peroxide and organo selenium compound to react thereby forming amorphous zero valent selenium particles dispersed in the matrix polymer; and (d) heating the matrix polymer/zero valent selenium combination to a temperature and for a time sufficient to convert the amorphous zero valent selenium to its crystalline, trigonal form.

DETAILED DESCRIPTION AND PREFERRED EMBODIMENTS

This invention involves a technique for the formation and crystallization of dispersed domains of amorphous selenium in polymer matrices. In this invention, organic nucleation sites for selenium are generated in situ. The technique disclosed herein overcomes the problems inherent in the thermal treatments of polymer films containing organochalcogen compounds which do not contain nucleation sites, and for which thermal processing yields only amorphous selenium.

Among those organic selenides which will react with dibenzoyl peroxide to provide zero valent selenium are the organo diselenides. Organo diselenides useful in the present invention are selected from those organo diselenides corresponding to the formula:

$R_1$—Se—Se—$R_2$

These compounds are capable of undergoing a decomposition reaction in response to activating radiation and yielding, as one of the products of such decomposition, elemental selenium. Typical of suitable compounds corresponding to the above formula which may be used are those organo diselenides wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl and alkyl alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl and nitro substituted alkyl; cyclo alkyl and substituted cyclo alkyl.

Many of the compounds within the scope of the above formula are readily available, and those not so available can be prepared by methods disclosed in the technical literature. For example, symmetrical dialkyl selenides can be prepared by the reaction of an alkyl halide with sodium selenide, M. L. Bird et al, J. Chem. Soc. 570 (1942); R. Paetzold et al, L. Amorg. Allg. Chem., 360, 293 (1968). The general method for the preparation of unsymmetrical dialkyl selenides is a modified Williamson synthesis, H. Rheinboldt, "Houben-Weyl Methodender Organischen Chemie," Volume IX, E. Muller, Ed., Georg Thieme Verlag, Stuttgart, pp. 972, 1005, 1020, and 1030 (1955).

Diselenides within the scope of the above formula can be prepared by alkaline hydrolysis of organo selenocyanates as disclosed by H. Bauer in Chem. Ber., 46, 92 (1913). The preparation of unsymmetrical diselenides suitable for use in the invention is accomplished by the reaction of organic selenyl bromides with organic selenols, H. Rheinboldt and E. Giesbrecht, Chem. Ber., 85, 357 (1952). Heterocyclic selenium compounds capable of undergoing substantial carbon-selenium bond scission upon irradiation with ultraviolet light can be prepared by the reaction of organic bromides with organic selenium compounds, L. Chierici et al, Ric. Sci., 25, 2316 (1955).

Organo monoselenides, such as, for example, benzomonoselenide, diphenylmethyl monoselenide, alkyl substituted benzyl monoselenide, and aryl substituted benzyl monoselenide, may be used as the selenium source. They will interact with dibenzoyl peroxide to provide zero valent selenium. Triphenylphosphine selenides may also be used in the present invention as the selenium source.

In any specific embodiment suitable for use as an electrostatographic photoreceptor structure, it is envisioned that a number of matrix polymers may be useful in the present invention. Poly(methylmethacrylate) (PMMA) is quite suitable. Preferred embodiments utilize polymers having glass transition temperatures, Tg, that are easily accessible by mild thermal treatments such as by heating to about 200° C. This is the case because exceeding the Tg will allow enhanced diffusion of selenium atoms or particles to nucleation sites for subsequent crystallization. Examples of matrix polymers include PMMA (Tg 72°-100° C.); poly(styrene) (Tg≃100° C.); poly(vinylalcohol) (Tg≃85° C.); and poly(carbonate) (Tg≃149° C.). Polymers having Tgs below room temperature may also be used.

In fabricating photosensitive layers according to the present invention, dibenzoyl peroxide, the organo selenium compound and the matrix polymer are combined in a suitable solvent such as benzene, chloroform or tetrahydrofuran. The solution is spread onto a conductive substrate, e.g. aluminum sheet, by standard film coating techniques and the solvent evaporated optionally with the aid of gently heating.

Typical concentrations of the particular elements in the film before solvent removal based on weight percent per 100 milliliters of solvent are from 5 to 25 percent dibenzyl peroxide, 5 to 15 percent organo selenium compound and from 5 percent matrix polymer up to its limit of solubility in the particular solvent being used.

After formation of the film, the interaction between the dibenzoyl peroxide and organo selenide will yield small particles of amorphous selenium. Heating the resulting film converts the amorphous selenium to trigonal selenium. The organic nucleation sites formed in situ during the practice of this invention are responsible for the relative ease with which the amorphous selenium can be thermally converted to trigonal selenium. The heating time and temperature will vary with the particular materials involved and their relative concentrations. Heating time and temperature are somewhat dependent upon the loadings of solids in the matrix polymer. In general heating temperatures of from 100° to 200° C for periods of 1 minute to 2 hours have been found sufficient to convert the amorphous selenium formed to its crystalline trigonal form. Too long of a heating period at too high a temperature can be detrimental because the selenium will volatilize from the film. The optimum heating time and temperature for a particular composition can be readily determined by routine experimentation.

The invention is further illustrated by the following examples in which all parts and percentages are by weight unless otherwise specified.

EXAMPLE I

A solution of 10% poly(methylmethacrylate), 5% benzyldiselenide and 10% dibenzoylperoxide in methylene chloride is solvent cast onto a Mylar substrate using a doctor blade set at a 4 mil gap. The film is dried and assumes a pale yellow color typical of benzyldiselenide.

Upon drying the film in the dark overnight at room temperature, it is converted to a uniform brick-red color typical of amorphous selenium dispersed throughout the poly(methylmethacrylate) matrix. While this invention is not intended to be predicated on any particular mechanism, a chain reaction is envisioned in which RSe· radicals attack the peroxide to form benzoyl radicals which subsequently attack benzyldiselenide to form benzyolbenzylester and RSeSe·. This radical decomposes to give amorphous selenium and RSe· radicals which completes the chain. The initial formation of either benzylselenyl or benzoyl radicals may trigger the process.

Upon heating brick-red films containing amorphous selenium prepared as described above for 1 minute, 3 minutes or 10 minutes at 100° C., a mahogany to blackish colored film results. X-ray powder pattern analysis identifies the selenium in the film to be in the trigonal crystalline form.

EXAMPLE II

A number of films are prepared as in Example I with variations being made in the concentrations of the dibenzoyl peroxide and benzyl diselenide. All of the films are prepared by casting from a 10% PMMA/$CH_2Cl_2$ solution using a 4-mil gap draw blade to provide a dry film having a thickness of approximately 4 μm. After thermally converting the amorphous selenium generated in situ to trigonal selenium, the optical densities of the films are determined at various wavelengths. Optical densities are determined by use of an ultraviolet/visible recording spectrophotometer with the heated crystalline selenium containing films in the sample side and an uncoated substrate on the reference side. The results of these experiments are set out in Table I.

TABLE I

Optical Densities of Thermally Prepared Trigonal Selenium in Pmma Films

| Run No. | % BDS | %$(RO)_2$ | T(° C) | t(Min) | Optical Density 4000Å | 5000Å | 6000Å | 6500Å | 7000Å |
|---|---|---|---|---|---|---|---|---|---|
| 1 | 5 | 7.5 | 150 | 1 | — | — | 1.62 | 1.62 | — |
| 2 | 5 | 7.5 | 150 | 5 | — | — | 1.19 | 1.18 | — |
| 3 | 5 | 7.5 | 150 | 120 | — | — | 1.68 | 1.75 | — |
| 4 | 5 | 10 | 150 | 1 | — | — | 1.16 | 1.17 | — |
| 5 | 5 | 10 | 150 | 1 | — | — | 1.48 | 1.50 | — |
| 6 | 5 | 10 | 150 | 120 | — | — | 2.29 | 2.39 | — |
| 7 | 7.5 | 7.5 | 150 | 120 | — | — | 1.53 | 1.53 | — |
| 8 | 10 | 15 | 150 | 1 | — | — | 2.11 | 2.14 | — |
| 9 | 10 | 15 | 150 | 3 | — | — | 1.92 | 1.92 | — |
| 10 | 10 | 15 | 150 | 3 | — | — | 3.10 | 3.00 | — |
| 11 | 10 | 15 | 150 | 120 | — | — | 2.83 | 2.86 | — |
| 12 | 10 | 15 | — | 0 | — | — | 0.59 | 0.47 | — |
| 13 | 10 | 15 | 125 | 5 | — | — | 1.08 | 1.07 | — |
| 14 | 10 | 15 | — | 0 | — | — | 0.10 | 0.02 | — |
| 15 | 10 | 15 | 125 | 5 | — | — | 0.87 | 1.07 | — |
| 16 | 10 | 15 | 125 | 7 | 1.12 | 0.83 | 0.75 | — | 0.68 |
| 17 | 10 | 15 | 125 | 14 | 1.00 | 0.70 | 0.70 | — | 0.68 |
| 18 | 10 | 15 | 125 | 28 | 0.70 | 0.52 | 0.52 | — | 0.53 |
| 19 | 10 | 15 | 125 | 56 | 0.68 | 0.43 | 0.43 | — | 0.43 |

a) Sample 14 photolyzed 120 minutes with unfiltered mercury arc prior to heating.
b) Samples 16–19 photolyzed 45 minutes prior to heating.

From the data of Table I it can be determined that there is an increase in optical density with increased heating times for lower loadings of BDS and $(RO)_2$, but optical density goes down with longer heating times at higher loadings due to volatilization of selenium. Optical densities increase with increased total loadings of organics and for a total 25% loading (10% BDS and 15% $(RO)_2$) increased temperature improves optical density. From this data it can be determined that all variables must be balanced and determined empirically although, in general, high loadings of organics, high temperatures and short heating times seem to provide films having high optical densities.

EXAMPLE III

Additional experiments are conducted in which the relative proportions of BDS and dibenzoylperoxide are varied as well as the heating time and temperature. Polymers other than PMMA are used. All films are prepared by draw blade coating from 10% polymer solutions. A summary of these experiments is set out in Table II.

TABLE II

Thermal Conversion Of Amorphous To Trigonal Selenium In Situ In Solid Polymer Film Matrices

| Sample No. | Polymer Matrix | Selenium Precursors BDS % wt. | (RO)2 % wt. | Total Solids % wt. | Fabrication Conditions T(° C) | Time(min) | Results |
|---|---|---|---|---|---|---|---|
| 1 | PMMA | 5 | 0 | 12.5 | 150 | 30 | No evidence of trigonal selenium |
| 2 | PMMA | 5 | 5 | 10.0 | 160 | 1 | Amorphous selenium, no conversion |
| 3 | PMMA | 5 | 5 | 10.0 | 150 | 120 | Trigonal selenium |
| 4 | PMMA | 5 | 7.5 | 12.5 | 160 | 1, 2 | Trigonal selenium confirmed by X-ray analysis |
| 5 | PMMA | 5 | 7.5 | 12.5 | 150 | 120 | Trigonal selenium |
| 6 | PMMA* | 5 | 7.5 | 12.5 | 100 | 120 | Overcoat results in better conversion at lower tempeatures |
| 7 | PMMA | 5 | 10 | 15.0 | 100 | 1 | Red Brown (conversion to trigonal allomorph improves with increased heating time at 100° C) |
| 7a | " | " | " | " | " | 3 | Dark Brown |
| 7b | " | " | " | " | " | 5 | Black |
| 8 | PMMA | 5 | 10 | 15.0 | 15.0 | 3 | Dark Brown |
| 8a | " | " | " | " | 160 | 1 | Gray Black (allomorphic conversion improves with increasing temperature) |
| 8b | " | " | " | " | 180 | 1 | Black |
| 9 | PMMA | 7.5 | 7.5 | 15.0 | 150 | 120 | (Allomorphic conversion improves with increasing total organic loadings at fixed temperature and heating times for PMMA matrix) |
| 10 | PMMA | 7.5 | 11.0 | 18.5 | 150 | 1,5,40,20 | |
| 11 | PMMA | 10 | 15 | 25.0 | 150 | .2,30,120 | |
| 12 | Lexan Polycarbonate | 5 | 7.5 | 12.5 | 160 | 1,1.5 | Trigonal selenium confirmed by X-ray |
| 13 | Lexan Polycarbonate | 15 | 22.5 | 37.5 | 100 | 120 | Trigonal selenium |
| 14 | Lexan Polycarbonate | 10 | 15 | 25 | 150 | 1 | Amorphous and trigonal selenium |

TABLE II-continued

| Thermal Conversion Of Amorphous To Trigonal Selenium In Situ In Solid Polymer Film Matrices | | | | | | | |
|---|---|---|---|---|---|---|---|
| | | Selenium Precursors | | Total | Fabrication Conditions | | |
| Sample No. | Polymer Matrix | BDS % wt. | (RO)2 % wt. | Solids % wt. | T(° C) | Time(min) | Results |
| 15 | " | " | " | " | " | 120 | Trigonal selenium |

*a poly(vinylcarbazole) overcoat is applied to this sample

What is claimed is:

1. A method of forming a layer of particulate trigonal selenium dispersed in a polymer matrix which comprises:

(a) forming a solution containing:

i. dibenzoyl peroxide, ii. an organo selenium compound which interacts with dibenzoyl peroxide to form zero valent selenium, and iii. a matrix polymer which is substantially non-reactive with dibenzoyl peroxide and the organo selenium compound, in a volatile solvent;

(b) applying the solution to a substrate in the form of a thin film;

(c) allowing the dibenzoyl peroxide and organo selenium compound to react thereby forming amorphous zero valent selenium particles dispersed in the matrix polymer; and (d) heating the matrix polymer/zero valent selenium combination to a temperature and for a time sufficient to convert the amorphous zero valent selenium to its crystalline, trigonal form.

2. A method in accordance with claim 1 wherein the organo selenium compound is an organo diselenide of the formula $R_1$—Se—Se—$R_2$ wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl and alkyl alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl and nitro substituted alkyl; cyclo alkyl and substituted cyclo alkyl.

3. The method of claim 1 wherein the organo selenium compound is an organo monoselenide.

4. The method of claim 3 wherein the organo monoselenide is benzomonoselenide, diphenylmethyl monoselenide, and alkyl substituted benzyl monoselneide or an aryl substituted benzyl monoselenide.

5. The method of claim 1 wherein the matrix polymer has a glass transition temperature that is accessible by heating to about 200° C.

6. The method of claim 5 wherein the matrix polymer is poly(methylmethacrylate), poly(styrene), poly(vinylalcohol), or a poly(carbonate).

7. The method of claim 1 wherein the film is heated to a temperature of from 100° to 200° C. for a period of 1 minute to 2 hours.

* * * * *